United States Patent [19]

Wilkerson

[11] 4,270,432

[45] Jun. 2, 1981

[54] CAPO

[76] Inventor: James W. Wilkerson, Highway 64 East, Savannah, Tenn. 38372

[21] Appl. No.: 89,158

[22] Filed: Oct. 29, 1979

[51] Int. Cl.[3] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 468,193 | 2/1892 | Dahlman et al. | 84/318 |
| 4,149,443 | 4/1979 | Bringe | 84/318 |

*Primary Examiner*—Lawrence R. Franklin

*Attorney, Agent, or Firm*—Harrington A. Lackey

[57] ABSTRACT

A capo including a top pressure bar and a bottom pressure bar projecting from a frame, respectively, above and below the neck of a stringed musical instrument. The bottom pressure bar is operatively connected to a manual lever through a toggle mechanism for movement of the bottom pressure bar toward and away from engagement with the bottom surface of the neck in response to the movement of the manual lever, the top pressure bar being adapted to force the strings against the fret board in operative position in order to raise the pitch of the instrument.

3 Claims, 4 Drawing Figures

CAPO

BACKGROUND OF THE INVENTION

This invention relates to a capo for attachment to the neck of a stringed musical instrument, in order to raise the pitch of the instrument.

Capos of various constructions are well known in the art.

Examples of such capos are illustrated in the following patents:

U.S. Pat. Nos.

3,722,346 Valentino: Mar. 27, 1973
3,823,247 Bauerfeind: July 9, 1974
3,933,073 Hutchins: Jan. 20, 1976
4,048,894 Myerson et al: Sept. 20, 1977
4,104,947 Oster: Aug. 8, 1978

Foreign Patents

German Pat. No. 382448: Oct. 2, 1923

All of the above patents disclose various types of capos having a top pressure bar and a lower pressure member connected to the top pressure bar for either swinging or translatory relative movement between the top pressure bar and the lower pressure member.

All of the capos disclosed in the above patents are provided with different types of structure for holding and releasing the pressure member of the top pressure bar in engagement with the strings and the fret board.

However, none of the above capos include a toggle mechanism for automatically locking the pressure members in operative position by movement of the toggle mechanism past a dead-center position.

SUMMARY OF THE INVENTION

It is therefore an object of this invention to provide a capo having a top pressure bar and a bottom pressure bar operatively connected by a toggle mechanism for moving the pressure bars toward and away from each other about the neck of a stringed musical instrument and for automatically latching the pressure bars in their operative position.

It is also an object of this invention to provide a capo having an adjustment means for varying the pressure of the top and bottom pressure bars against the neck of a stringed musical instrument, in operative position.

More specifically, the capo made in accordance with this invention includes a frame adapted to be disposed along one side of the neck of a stringed musical instrument, and a top pressure bar fixed to and projecting laterally from the frame across the fret board and adapted to engage and press the strings against the fret board. A bottom pressure bar is pivotally mounted upon the frame and operatively connected through a toggle linkage to a manually operable lever. When the lever is moved to its inoperative position, the toggle linkage is moved to one side of a dead-center position to permit the bottom pressure bar to swing away from the top pressure bar and the neck of the stringed musical instrument. When the manual lever is swung to its operative position, the toggle linkage swings to another position on the opposite side of dead-center to clamp the bottom pressure bar and the top pressure bar tightly against the neck of the guitar, thereby automatically holding both pressure bars in their operative positions.

The bottom pressure bar is preferably mounted on one end of a mounting arm, the opposite end of which is connected to the toggle linkage on the frame. The mounting arm is supported between its ends in bearing engagement against a rotary, eccentric, disc-shaped cam. The disc-shaped cam is adapted for rotary adjustable movement in order to vary the pressure which the bottom pressure bar exerts against the bottom surface of the neck of the stringed musical instrument, or for adjustment of the spacing between the top and bottom pressure bars to fit about the necks of different sizes of different stringed musical instruments.

DESCRIPTION OF THE PREFERRED EMBODIMENTS

Figure 1:
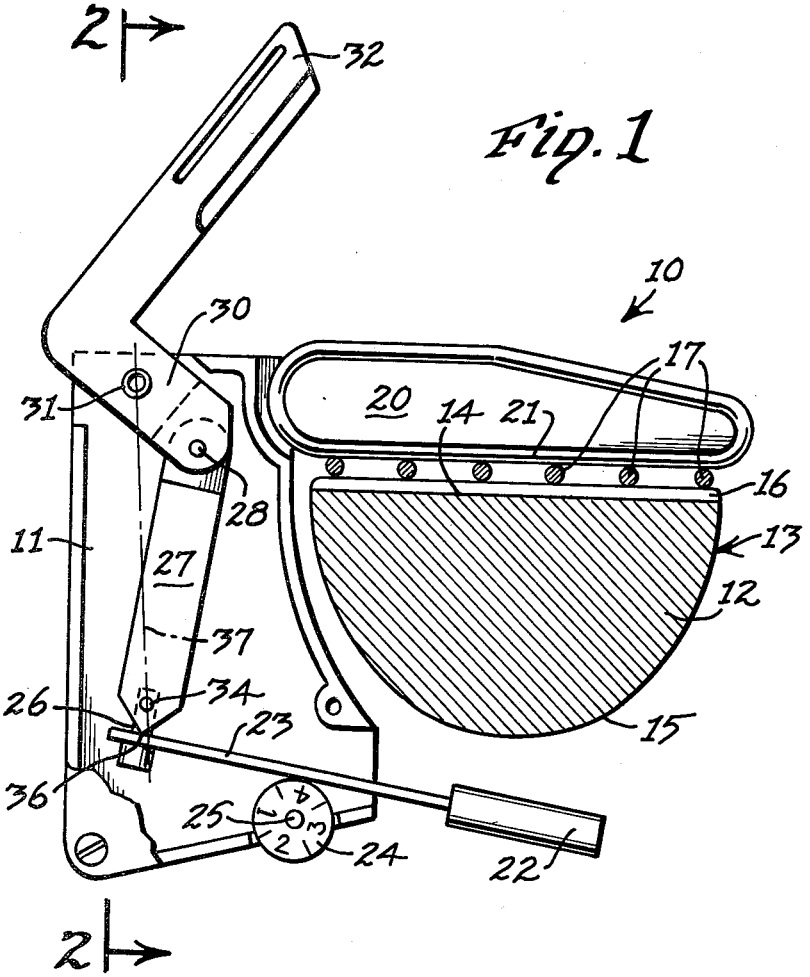
FIG. 1 is a side elevation of the capo made in accordance with this invention, with portions of the frame housing removed, illustrating the capo in its inoperative position about the neck of a stringed musical instrument, shown in transverse section.
Figure 2:
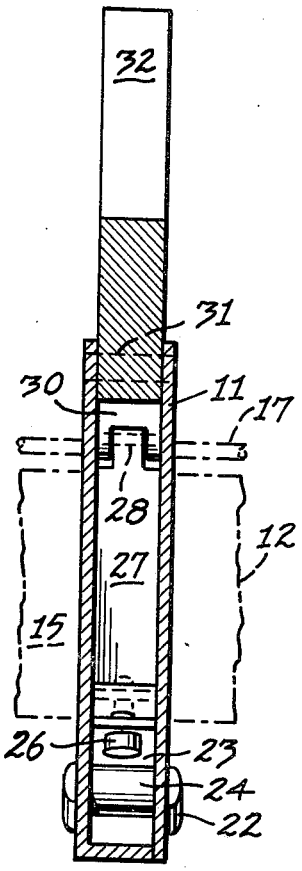
FIG. 2 is a section taken along the line 2—2 of FIG. 1.

Referring now to the drawings in more detail, the capo 10 made in accordance with this invention includes a side frame or housing 11 having a height slightly greater than the depth of the neck 12 of a stringed musical instrument 13 upon which the capo 10 is to be used. The neck 12 includes a flat top surface or fret board 14, a rounded bottom surface 15, a plurality of longitudinally spaced transverse frets 16 mounted on the top surface or fret board 14 supporting a plurality of strings 17 disposed parallel to the longitudinal axis of the neck 12.

Figure 3:
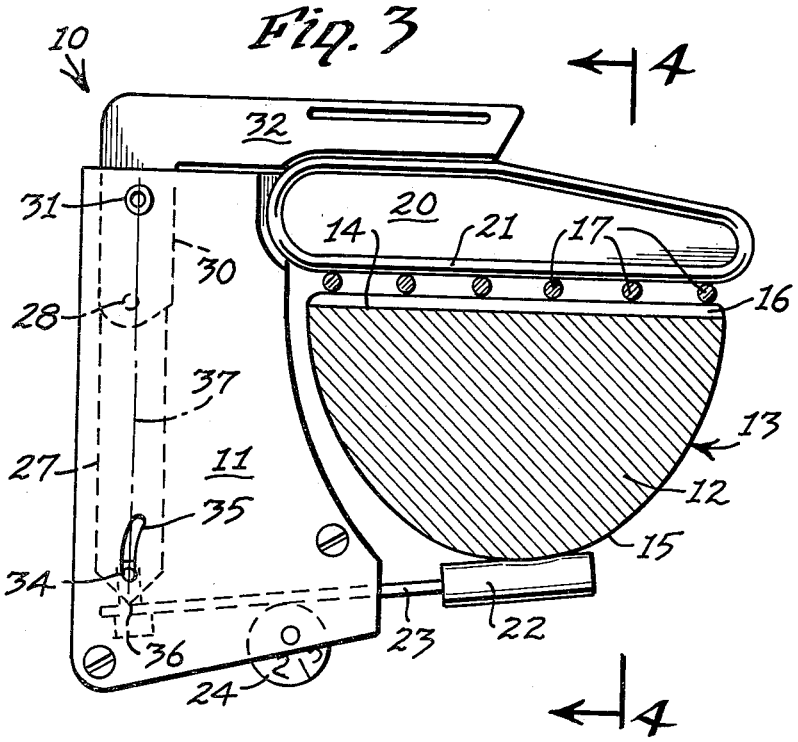
FIG. 3 is a view similar to FIG. 1 illustrating the capo in operative position.
Figure 4:
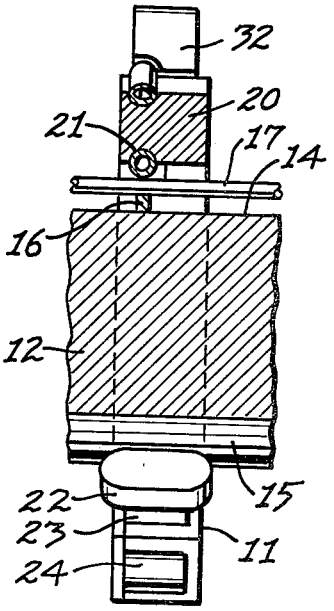
FIG. 4 is a section taken along the line 4—4 of FIG. 3.

Fixed to and projecting laterally from the side frame 11 is the top pressure bar 20 having a length sufficient to span the entire transverse dimension of the neck 12 when in operative position, as disclosed in FIGS. 1 and 3.

Mounted upon the top pressure bar 20 is an elongated resilient member 21 to provide a soft surface for engaging the strings 17 transversely, not only to prevent damage to the strings 17, but also to provide more uniform pressure to the strings 17 to prevent altering their pitch from standard. The particular structure of the resilient member 21, as disclosed in the drawings, is an endless rubber, or soft plastic, tubular member, such as O-ring, encompassing the transverse dimension of the top pressure bar 20.

Adapted to engage the bottom surface 15 of the neck 12 is a bottom pressure bar 22 fixed on the remote end of a mounting arm 23 which projects laterally from the housing 11 in the same direction as the top pressure bar 20. The mounting arm 23 is pivotally supported in the frame 11 by bearing upon a disc-shaped cam member 24 eccentrically mounted upon a hub or shaft 25 for rotary adjustable movement, thereby shifting the elevation of the fulcrum of the mounting arm 23 relative to the frame 11.

The proximal end of the mounting arm 23 is attached by a connector, in the form of a headed screw or pin 26, to the lower end of a link arm 27. The upper end of the link arm 27 is secured by a hinge pin 28 to the free end of a toggle arm 30 journaled to the frame 11 by a journal pin 31.

In order to manipulate and control the toggle mechanism formed by the toggle arm 30 and the link arm 27, a manual lever or lever handle 32 is fixed to the toggle arm 30 on the opposite side of the journal pin 31 from the hinge pin 28, and in fact is integral with the toggle arm 30 to form an L-shaped member, in which the longer leg is the lever 32 and the shorter leg is the toggle arm 30.

The lower end portion of the link arm 27 is provided with a pair of outwardly directed opposed guide pins 34 for traveling in the arcuate guide slots 35 (FIG. 3) provided in the opposite walls of the housing 11, a structural feature which is optional.

It will be noted in FIG. 1, that the hinge pin 28 is disposed to the right of the dead-center line 37 passing through the journal pin 31 and the lower edge 36 of the link bar 27. When the lever 32 is moved to its operative clamping position, as illustrated in FIG. 3, the bottom pressure bar 22 is forced upward toward the top pressure bar 20 and into engagement with the lower surface 15 of the neck 12, while the top pressure bar 20 clamps the strings 17 against the frets 16. In the clamping position of FIG. 3, the hinge pin 28 is swung to the left of the dead-center line 37 to lock the top pressure bar 20 and the bottom pressure bar 22 against the neck 12 of the stringed musical instrument 13.

In the operation of the capo 10, the lever 32 is initially in a raised inoperative position, as disclosed in FIG. 1, with the bottom pressure bar 22 moved away from the neck 12. The rotary eccentric disc or cam member 24 is rotated to the desired adjusted position which will cause the bottom pressure bar 22 to exert the desired pressure against the bottom surface 15 of the neck 12.

The top pressure bar 20 is then placed transversely over the fret board so that the transverse resilient member or element 21 will transversely engage all of the strings 17 at the desired longitudinal position above the adjacent transverse frets 16 on the neck 12. In this inoperative position, the bottom pressure bar 22 is extended under, but spaced from, the bottom surface 15 of the neck 12, as illustrated in FIG. 1.

The lever 32 is then manually depressed, causing the hinge pin 28 to swing in a clockwise direction about the journal pin 31, simultaneously causing the end 36 of the link arm 27 to bear down upon the proximal end of the mounting arm 23, thereby causing the mounting arm 23 to pivot or rotate about the cam bearing member 24, and raising the bottom pressure bar 22 upward into engagement with the bottom surface 15 of the neck 12, as illustrated in FIG. 3. When the lever 32 has reached its lowermost operative position, the hinge pin 28 will have swung past the dead-center line 37 containing the journal pin 31 and the bottom end 36 of the link arm 27, to completely lock the top pressure bar 20 and the bottom pressure bar 22 in their clamped positions, for as long as desired, and until the lever 32 is again raised to its inoperative position.

In this manner, a capo 10 has been provided which is easily manipulated in order to clamp the top pressure bar 20 down against the strings 17 quickly and with an automatic latching action, eliminating any additional manipulations in order to lock the top pressure bar 20 and the bottom pressure bar 22 in their clamped positions.

Furthermore, the capo 10 made in accordance with this invention provides an adjustment for varying the final clamped positions of the top pressure bar 20 and the bottom pressure bar 22, since such positions are automatically attained upon depression of the lever 32 and the resultant movement of the hinge pin 28 past the dead-center line 37. Such adjustment device includes the eccentrically mounted rotary disc-shaped cam bearing member 24 upon which is supported the pivotal or swinging mounting arm 23.

Of course, the bottom pressure bar 22 is appropriately padded in order to provide a soft surface for resiliently engaging the bottom surface 15 of the neck 12 of the stringed musical instrument 13.

When it is desired to release the capo 10 from the particular musical instrument 13, the lever 32 is merely raised to cause the hinge pin 28 to move back across the dead-center line 37 (to the right in FIG. 1), thereby unlatching the pressure arms 20 and 22 and causing the bottom pressure bar 22 to move away from the neck 12.

What is claimed is:

1. A capo for attachment to the neck of a stringed musical instrument, said neck having a longitudinal axis, opposite sides, a top surface and a bottom surface, transverse frets disposed on said top surface and a plurality of strings disposed parallel to said longitudinal axis, comprising:

(a) a frame, (b) an elongated top pressure bar projecting from said frame and adapted to extend transversely to said longitudinal axis over said top surface and to engage said strings when said frame is located along one side of said neck in operative position, (c) a mounting arm having a remote end terminating in a bottom pressure bar, a proximal end, and an intermediate portion between said remote end and said proximal end, (d) means supporting the intermediate portion of said mounting arm for pivotal movement about an axis parallel to said longitudinal axis for movement of said bottom pressure bar between an operative position engaging the bottom surface of the neck of a musical instrument and an inoperative position away from said bottom surface, (e) a manual lever terminating in a toggle arm, having a free end, (f) a journal member connecting said toggle arm to said frame above said mounting arm and between said free end and said manual lever, for pivotal movement about an axis parallel to said longitudinal axis, (g) a link bar having upper and lower ends, (h) a connector member connecting the lower end of said link bar to the proximal end of said mounting arm, (i) a hinge pin member pivotally connecting the free end of said toggle arm to the upper end of said link bar, whereby said hinge pin member is adapted to move past a dead-center line extending through said journal member and said connector member, when said manual lever moves to its operative position, causing said bottom pressure bar to move to its operative position and said top pressure bar to engage and force said strings against a fret.

2. The invention according to claim 1 in which said means for pivotally mounting the intermediate portion of said mounting arm to said frame comprises a transversely extending bearing member having a smooth, uninterrupted bearing surface engaging the bottom surface of the intermediate portion of said mounting arm.

3. The invention according to claim 2 in which said bearing member comprises a rotary cam bearing member and means rotatably mounting said cam bearing member on said frame about an axis parallel to said longitudinal axis, said bearing surface being eccentric to said rotary axis, said cam bearing member being adapted to be rotatably adjusted to vary the pressure of said pressure bars against said neck in their operative position.

* * * * *